US007013516B1

(12) United States Patent
Peters

(10) Patent No.: US 7,013,516 B1
(45) Date of Patent: Mar. 21, 2006

(54) HAMMER

(75) Inventor: David L. Peters, West Chester, OH (US)

(73) Assignee: Ready Products, Inc., West Chester, OH (US)

( * ) Notice: Subject to any disclaimer, the term of this patent is extended or adjusted under 35 U.S.C. 154(b) by 0 days.

(21) Appl. No.: 10/462,870

(22) Filed: Jun. 17, 2003

(51) Int. Cl.
*B25D 1/04* (2006.01)

(52) U.S. Cl. ..... 7/146; 7/164; 7/165; 7/167; 81/177.4; 81/490

(58) Field of Classification Search ..... 7/146, 7/143, 167, 164, 165; 81/20, 25, 490, 177.4; 33/413, 414
See application file for complete search history.

(56) References Cited

U.S. PATENT DOCUMENTS 1,109,507 A * 9/1914 Bostock ..... 81/23
1,250,328 A * 12/1917 Langford ..... 81/436
2,933,679 A * 4/1960 Bray ..... 7/901
4,268,927 A * 5/1981 Bridwell ..... 7/143
4,332,046 A * 6/1982 Foley et al. ..... 7/146
4,352,306 A * 10/1982 Martinmaas ..... 81/177.4
4,438,538 A * 3/1984 Larsen ..... 7/164
5,255,575 A * 10/1993 Williams ..... 81/25
6,108,926 A * 8/2000 Fraser et al. ..... 33/768
6,122,788 A * 9/2000 Bulcock ..... 7/146
6,188,228 B1 * 2/2001 Philipp ..... 324/658

* cited by examiner

*Primary Examiner*—Hadi Shakeri
(74) *Attorney, Agent, or Firm*—Wood, Herron & Evans, L.L.P.

(57) ABSTRACT

The present invention is directed to a hammer having a number of accessories including a storage cavity adapted to efficiently and conveniently hold tools, supplies, and the like and/or an additional number of accessories. The hammer comprises a hammer head having a front portion adapted for striking a nail or a tack, and a handle having a longitudinal extending cavity therein. A tray tailored to fit and slide within the longitudinal extending cavity is provided and is adapted to support a plurality of accessories.

7 Claims, 9 Drawing Sheets

HAMMER

BACKGROUND OF THE INVENTION

The present invention relates to a hammer and, more particularly, to a hand-held hammer having a handle assembly effective for supporting and storing an assortment of independent tools and/or accessories.

Various hand held tools, such as hammers, having hollow handles for storing accessories have been developed. Hammers have also been developed that have handles effective for storing various tools and/or accessories, such as nails, tacks and the like typically used with a hammer to make repairs or to assemble or hold parts together. Hammers have also been developed that incorporate other related tools. For example, in U.S. Pat. No. 102,677 to Gregory discloses a hammer having a handle containing a longitudinal bore for randomly storing supplies or other small tools, and further includes a ruler on the side of the hammer. U.S. Pat. No. 1,109,507 to Bostock discloses a hammer having various slots bored in the length of the handle to store a screw driver, a drill bit, and a saw blade. U.S. Pat. No. 6,122,788 to Bulcock discloses a hammer having accessories such as a level, a storage compartment for supplies, and a retractable ruler. Unfortunately, such tools have shown to be not particularly efficient, or are poorly organized, or are limited to only a few specific accessories.

Accordingly, there is a need for a hammer having a variety of accessories including at least one storage compartment adapted to efficiently and conveniently hold tools, supplies and the like and/or an additional number of accessories in an organized manner.

SUMMARY OF THE INVENTION

The present invention is directed to a new and novel hammer having a number of accessories including at least one storage compartment adapted to efficiently and conveniently hold tools, supplies, and the like and/or an additional number of accessories in an organized manner. The hammer comprises a hammer head having a front portion adapted for striking a nail or a tack, and a handle assembly comprising a handle body having a longitudinally extending cavity therein.

In a preferred embodiment of the invention, the hammer further comprises a tray tailored to fit and slide within the longitudinally extending cavity and is adapted to support the plurality of accessories. The handle assembly is further provided with an end cap for securing the tray within the cavity.

In another preferred embodiment of the invention, the hammer further comprises a multipurpose tool adapted for storage within the longitudinally extending cavity.

In a preferred embodiment of the invention, the hammer further comprises at least one related tool.

In a preferred embodiment of the invention, the tray comprises at least one storage container for storing nails, tacks and the like.

In another preferred embodiment of the invention, the tray further comprises an attachment for securing the multipurpose tool.

In another preferred embodiment of the invention, the multipurpose tool is a tool selected from a group consisting of screw drivers, wrenches, saws, flashlights, chisels, ratchets, levels, or a combination thereof.

In another preferred embodiment of the invention, the cylindrical body of the multipurpose tool includes a longitudinally extending cavity for storing a plurality of tool bits.

In another preferred embodiment of the invention, the hammer comprises at least one level.

In another preferred embodiment of the invention, the handle assembly of the hammer of the present invention includes a removable end cap adapted for attaching to the base of the handle body and for attaching to the front portion of the hammer head to permit the hammer to function as a mallet.

In another preferred embodiment of the invention, the handle assembly of the hammer of the present invention comprises an end cap adapted for attaching to the base of the handle body and includes a retractable measuring tape incorporated therein.

In another preferred embodiment of the invention, the handle assembly of the hammer of the present invention comprises an end cap adapted for attaching to the base of the handle body and includes a retractable caulk line.

In another preferred embodiment of the invention, the handle assembly of the hammer of the present invention comprises an end cap adapted for attaching to the base of the handle body and includes a retractable caulk line and a retractable measuring tape incorporated therein.

In another preferred embodiment of the invention, the handle assembly of the hammer of the present invention comprises an end cap adapted for attaching to the base of the hammer body and includes a stud detector.

It will become apparent to those skilled in the art that the hammer of the present invention is easy to use, efficiently and conveniently holds a plurality of accessories in an organized manner. These and other advantages of the invention will be further appreciated from the following description, the accompanying drawings and the appended claims.

BRIEF DESCRIPTION OF THE DRAWINGS

To provide a more complete understanding of the present invention and further features and advantages thereof, reference is now made to the following description taken in conjunction with the accompanying drawings, in which.

DESCRIPTION OF A PREFERRED EMBODIMENT

The present invention relates to a hammer comprising a number of accessories including a handle assembly having at least one storage compartment adapted to efficiently and conveniently hold additional number of accessories, tools and various supplies. In describing the preferred embodiments of the invention, specific terminology will be resorted to for the sake of clarity. However, the invention is not intended to be limited to the specific terms so selected, and it is to be understood that each specific term includes all technical equivalents that operate in a similar manner to accomplish a similar purpose.

Figure 1:
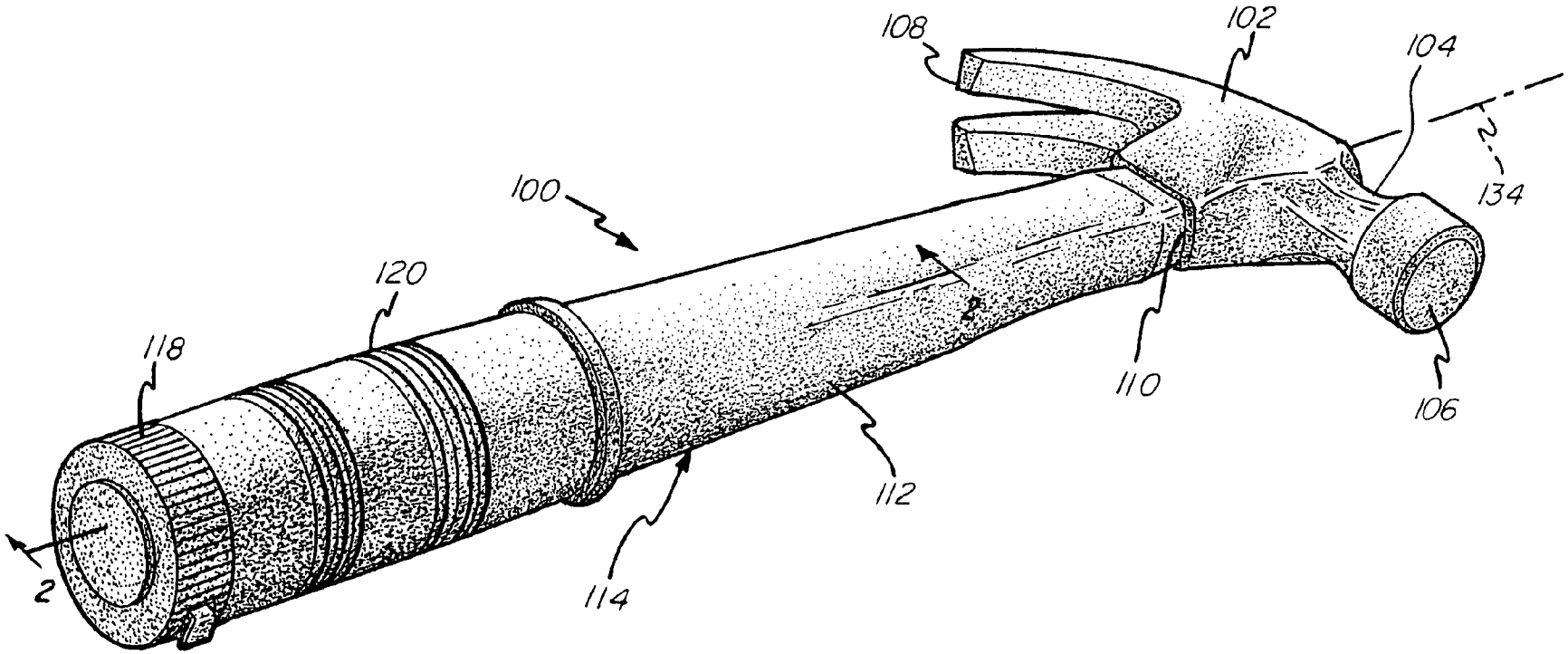
FIG. 1 is a perspective view of a preferred embodiment of the hammer of the present invention showing the hemmer head and the handle body in its assembled configuration.
Figure 2:
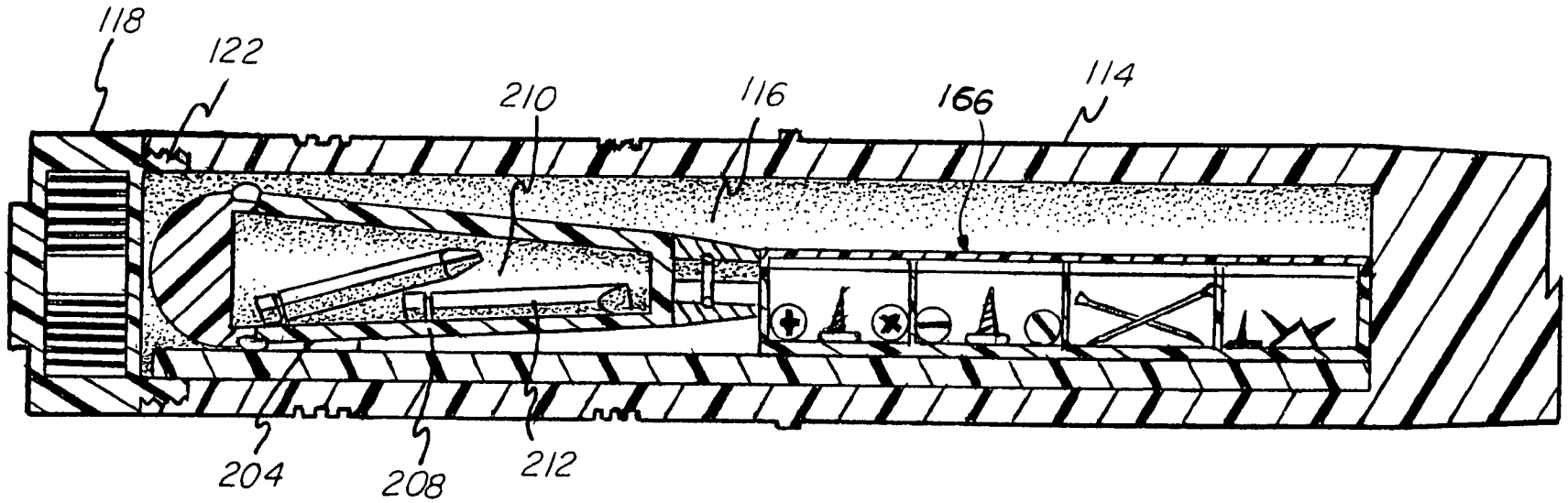
FIG. 2 is a cross-sectional view of the hammer of the present invention taken along line 2—2 of FIG. 1 showing a removable tray for supporting a container and a multipurpose tool stored within the handle body of the hammer.
Figure 3:
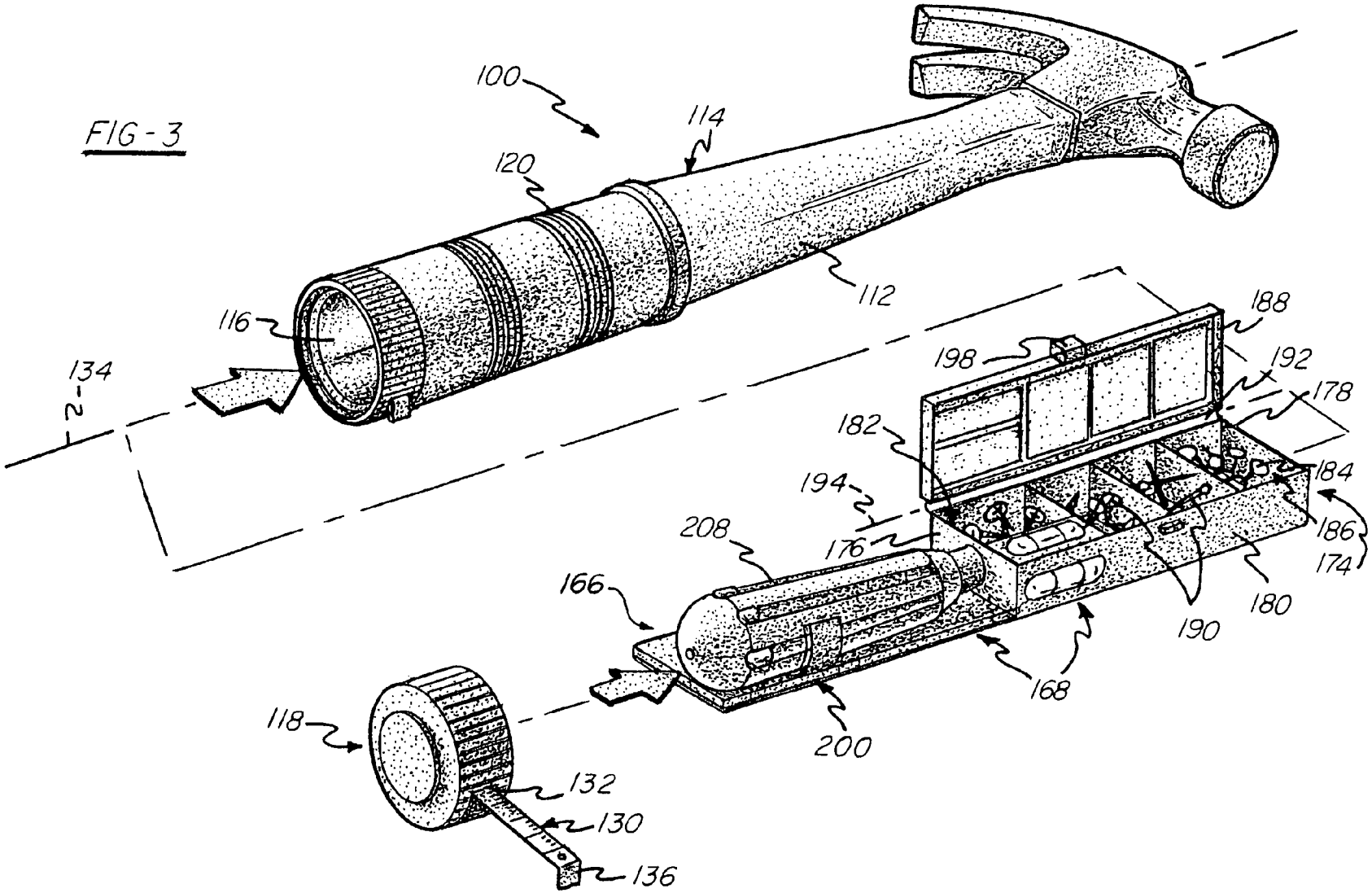
FIG. 3 is an exploded perspective side view of the hammer of FIG. 1 showing the tray removed from the handle body.

Referring to the drawings, a preferred embodiment of the present invention is shown in FIGS. 1, 2 and 3 which illustrate the basic components comprising the hammer of the present invention. As shown, the hammer, generally designated 100, comprises a hammer head 102 having a front portion 104 with a striking face 106 adapted for striking a nail or a tack, a nail removing claw portion 108 adapted for use in removing nails, tacks, and the like from a surface, and an eye portion 110. A generally cylindrical handle assembly 112 having a handle body 114 extends downwardly from and received in the eye portion 110 of the hammer head 102 and includes a longitudinally extending cavity 116 therein. An end cap 118 is provided and is adapted to engage with the lower end of the handle body 114.

The hammer head 102 is formed of a metal, such as steel, or some other solid, durable, and hard material. The handle body 114 is also formed from a metal, such as steel, or can be formed from molded plastic, or from wood, or a combination thereof. Depending on the materials selected, the hammer head 102 and the handle body 114 can be formed together or formed separately and conventionally attached together. As shown, the handle assembly 112 can also include a rubber or plastic grip 120 that encases the outer portion of the handle body 114 making it easier to grip during use.

In a preferred embodiment of the invention, the end cap 118 is formed from rubber, plastic or another elastomeric material. Referring to FIG. 2, the end cap 118 includes an inner member 122 effective for attaching to and disengaging with the open end of the longitudinally extending cavity 116. In a preferred embodiment of the invention, the inner member 122 of the end cap 118 is secured in place by a friction fit (as shown). It should be understood, however, that other conventional means may be used, such as by use of detents, threaded means, and the like which operate to removably attach the end cap 118 to the hammer body 114. As shown, the handle body 114 is also adapted to receive the eye portion 110 of the hammer head 102 and may be removably attached, such as by a friction fit, thereto.

Figure 4:
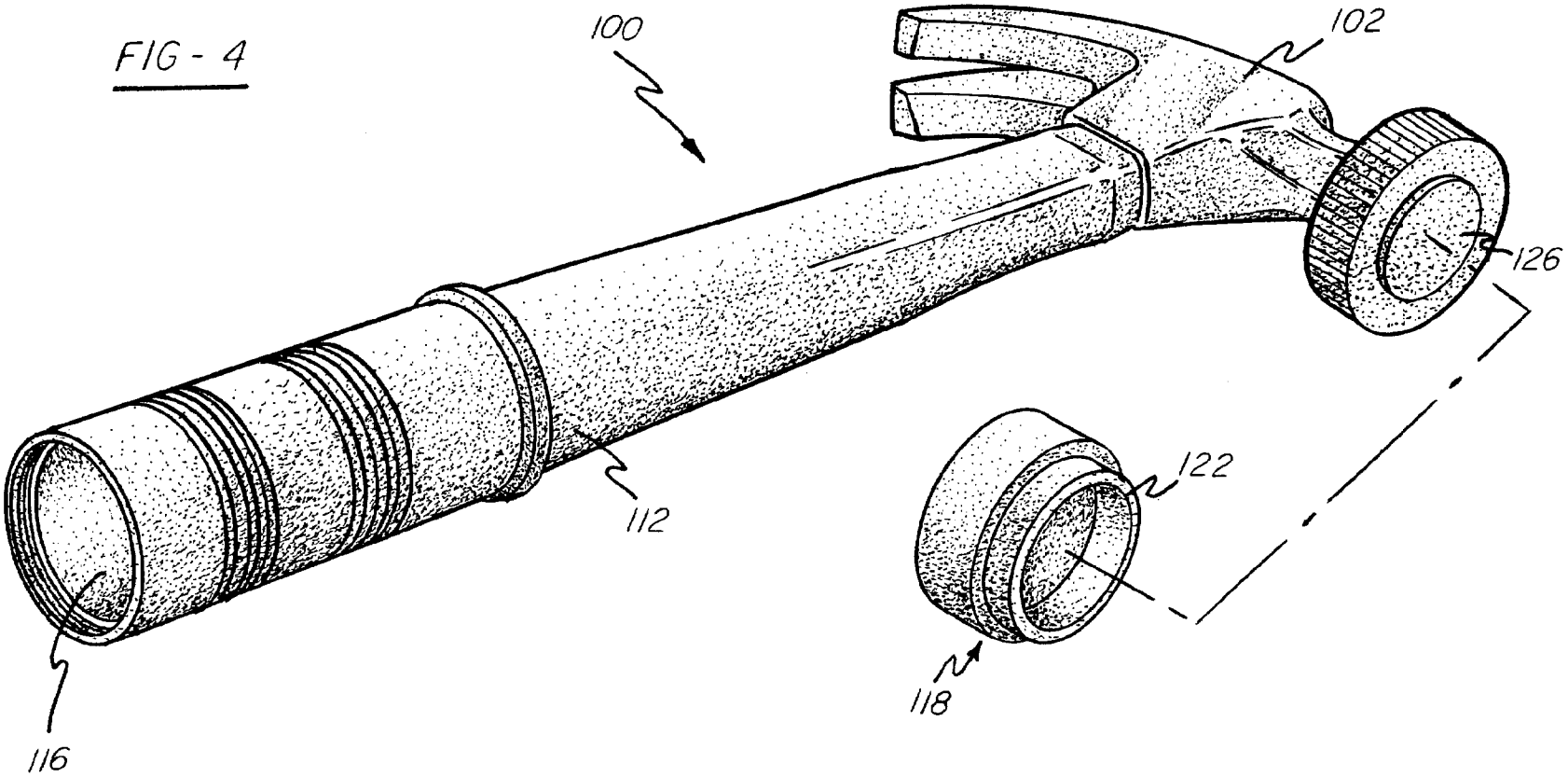
FIG. 4 is a perspective view of another preferred embodiment of the invention showing the end cap adapted for attaching to the handle body and for attaching to the front portion of the hammer head for permitting the hammer to function as a mallet.

Referring now to FIG. 4, another preferred embodiment of the present invention is shown whereby the inner member 122 of the end cap 118 includes an inner opening 124 adapted to receive the front portion 104 of the hammer head 102. It should now be apparent to those skilled in the art that the end cap 118 when attached to the front portion 104 of the hammer head 102 provides an elastomeric striking surface 126 that operates to permit the hammer 100 to function as a mallet. It should be understood that the handle assembly 112 can further comprise a conventional end plug (not shown) that fits snugly into the lower end of the longitudinally extending cavity 116 and operates to prevent items from sliding out of the cavity 116 when the end cap 118 is removed for attaching to the hammer head 102.

Referring to FIGS. 1 and 3, another preferred embodiment of the invention is shown whereby the end cap 118 has an internal cavity (not shown) effective for storing a conventional flexible recoil-type retractable measuring tape 130. The measuring tape 130 may be pulled, as shown in FIG. 3, through a channel 132 in the end cap 118 that is generally perpendicular to the longitudinal axis 134 of the handle body 114 and includes a conventional catch 136 affixed to its end for preventing the tape 130 from retracting completely into the internal cavity and for allowing the user to easily grip the tape 134 and pull it outwardly through the channel 132.

Figure 5:
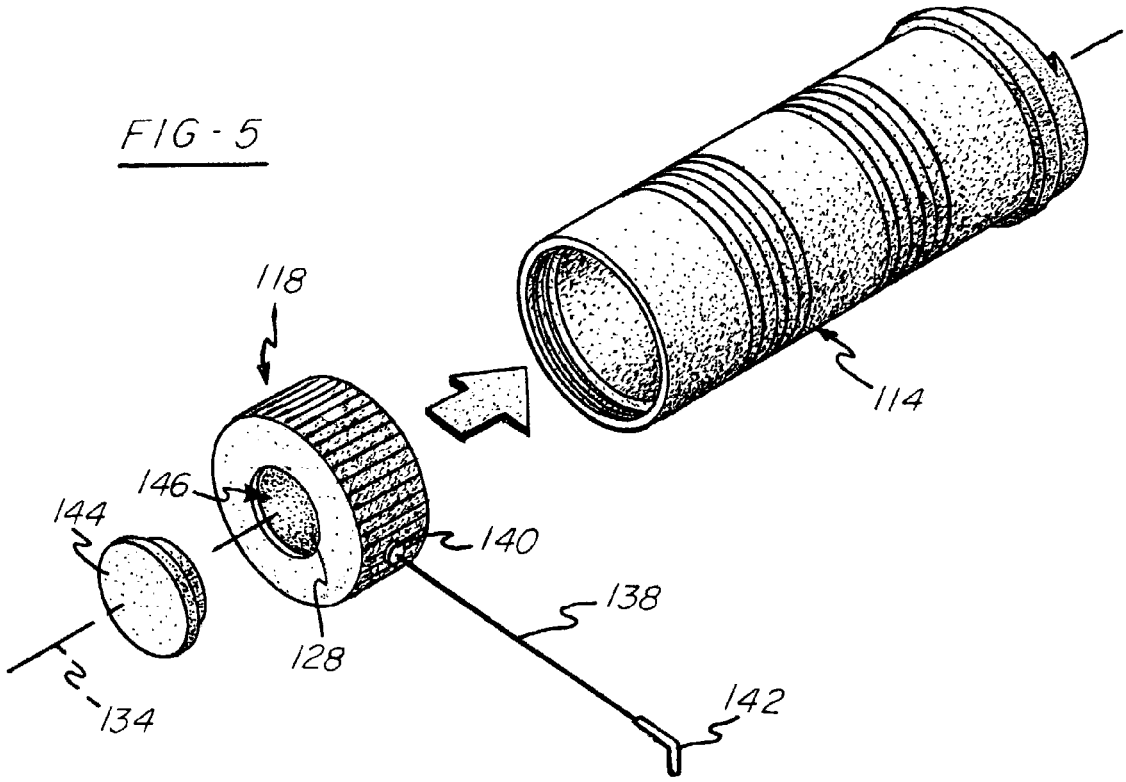
FIG. 5 is a fragmentary and exploded perspective view of the lower portion of the handle assembly of another preferred embodiment of the invention showing the end cap and a partially extended retractable caulk line.

Referring to FIG. 5, another preferred embodiment of the invention is shown whereby the end cap 118 includes an internal cavity 128 that is effective for storing a conventional recoil-type retractable chalk line 138. The chalk line 138 may be pulled through an opening 140 in the end cap 118 that is generally perpendicular to the longitudinal axis 134 of the handle body 114 and includes a conventional catch 142 affixed to its end for preventing the chalk line 138 from retracting completely into the internal cavity 128 and for allowing the user to easily grip the chalk line 138 and pull it out through the opening 140. A removable button 144 is provided that is adapted to fit over a similarly shaped aperture 146 that leads into the internal cavity 128 in the end cap 118 which is secured thereto by a friction fit, detents or the like. By prying up along the edge of the button 144, the button 144 can be removed, as shown, to permit a supply of caulk to be poured into the internal cavity 128. The internal cavity 128 then operates as a reservoir for the caulk to insure proper coating of the caulk line 138.

Figure 6:
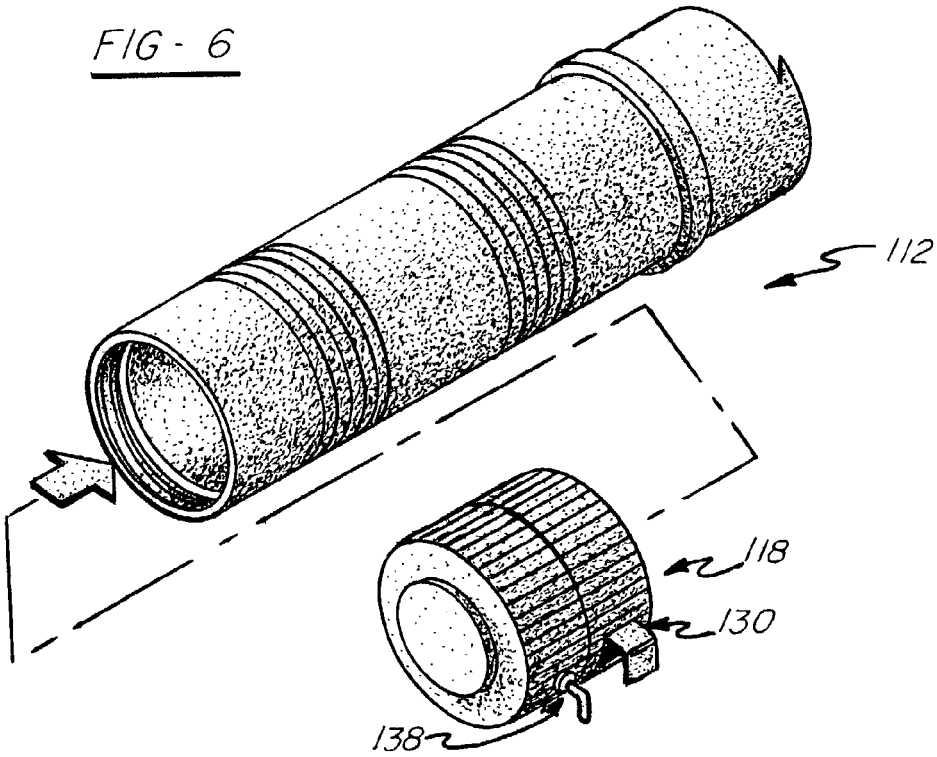
FIG. 6 is a fragmentary and exploded perspective view of the lower portion of the handle assembly of another preferred embodiment of the invention showing the end cap having a retractable caulk line and a retractable measuring tape incorporated therein.

It should now be apparent, as shown in FIG. 6, that the handle assembly 112 of the hammer 100 of the present invention can be provided with an end cap 118 that is adapted to provide and support both the flexible recoil-type retractable measuring tape 130 and a flexible recoil-type retractable chalk line 138.

Figure 7:
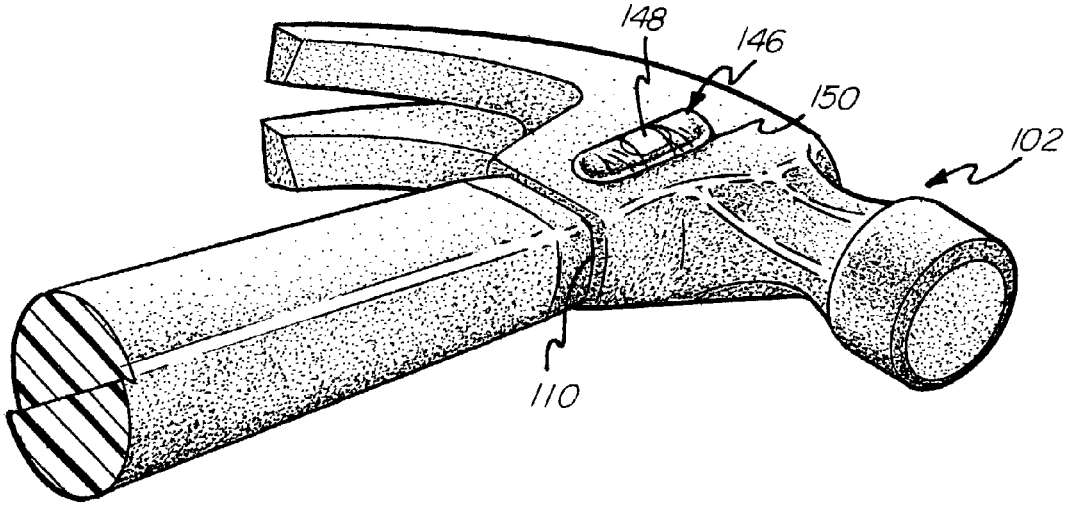
FIG. 7 is a partial perspective view of another preferred embodiment of the invention showing the hammer head with a level mounted thereto.

Referring to FIG. 7, another preferred embodiment of the invention is shown whereby at least one conventional bubble level 146 comprising a level vial 148 may be mounted within an elongated aperture 150 within the eye portion 110 of the hammer head 102. It should be understood that the level vial 148 may be permanently mounted within the aperture 150 or may be removably mounted within the aperture 150 between a pair of spaced vial holders (not shown).

Figure 8:
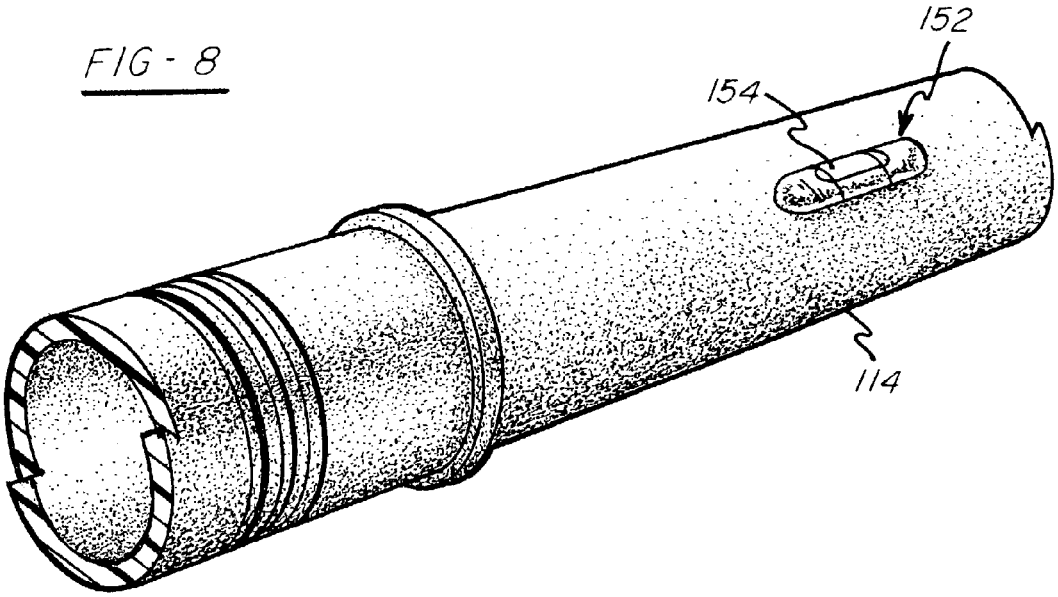
FIG. 8 is a partial perspective view of another preferred embodiment of the invention showing the lower portion of the handle assembly showing a level mounted thereto.

Referring to FIG. 8, another preferred embodiment of the invention is shown having at least one conventional bubble level 152 comprising a level vial 154. In a preferred embodiment of the invention, the level vial 154 is mounted longitudinally along the handle body 114, such as by an adhesive. It should also now be understood that the level vial 154 can also be mounted using a conventional vial holder (not shown) that is adapted for holding and removably securing the level vial 154 to the handle body 114.

Figure 9:
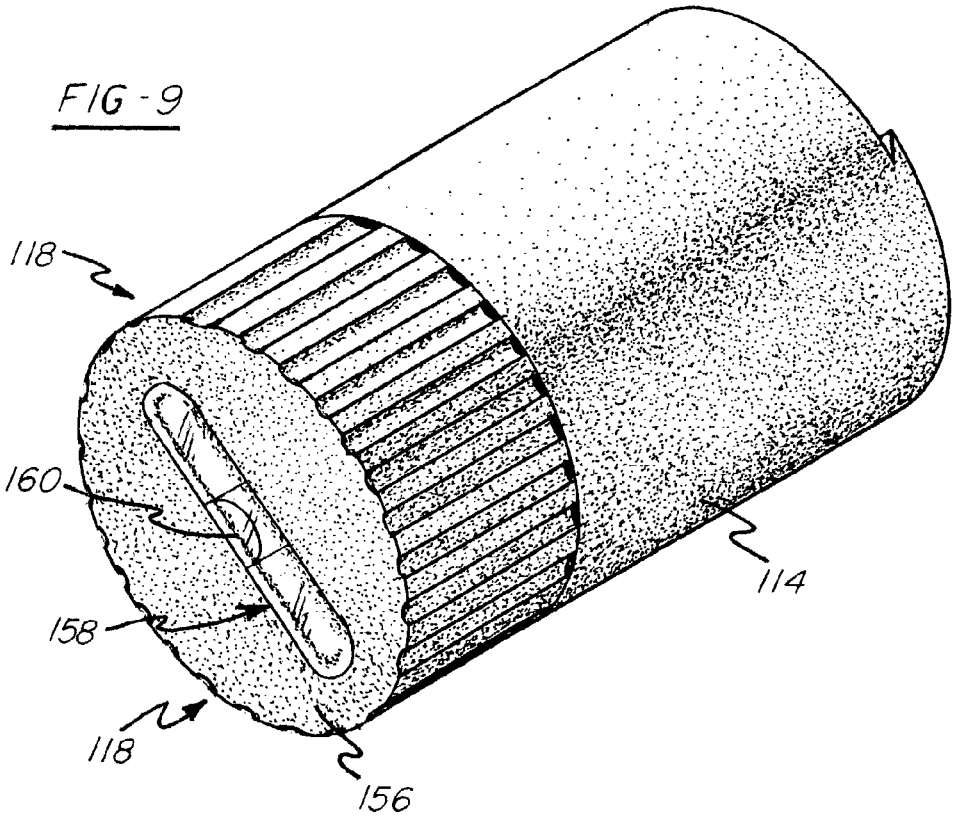
FIG. 9 is a partial perspective view of another preferred embodiment of the invention showing the end cap of the handle assembly having a level incorporated therein.

In another preferred embodiment of the invention, as shown in FIG. 9, the outer surface 156 of the end cap 118 can include a conventional bubble level 158 having a level vial 160 attached to the outer surface 156 by an adhesive (as shown) or within a cavity or by a conventional vial holder. In use, the end cap 118 can be removed from the handle body 114 and placed along the surface to be leveled.

Figure 10:
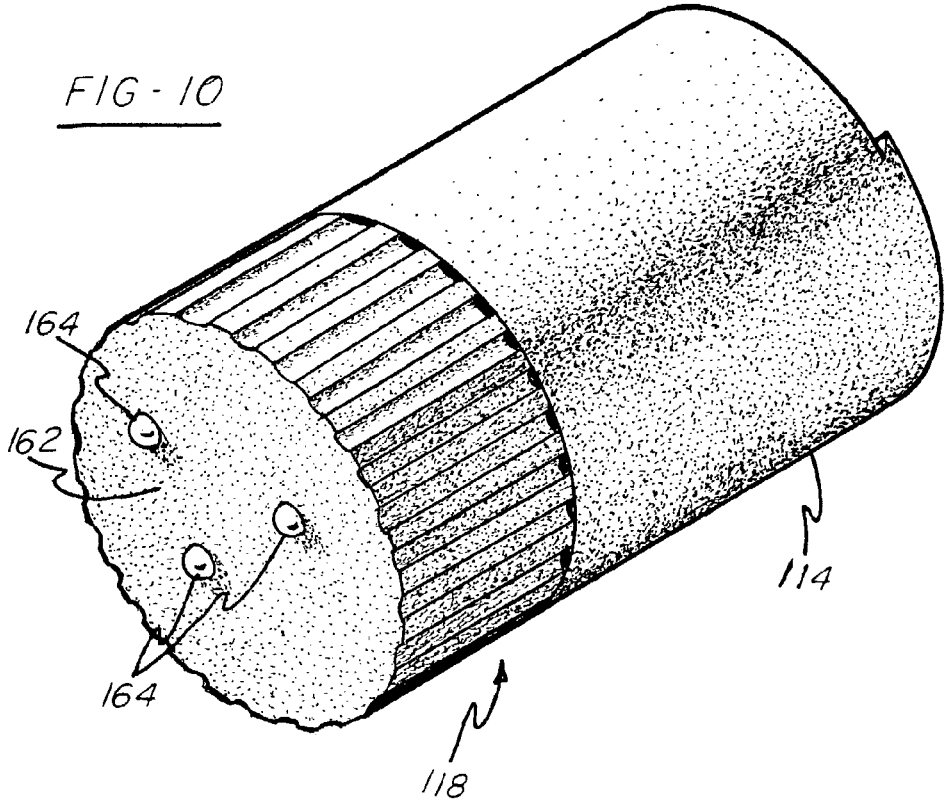
FIG. 10 is a partial perspective view of another preferred embodiment of the invention showing the end cap of the handle assembly having a stud sensor incorporated therein.
Figure 11:
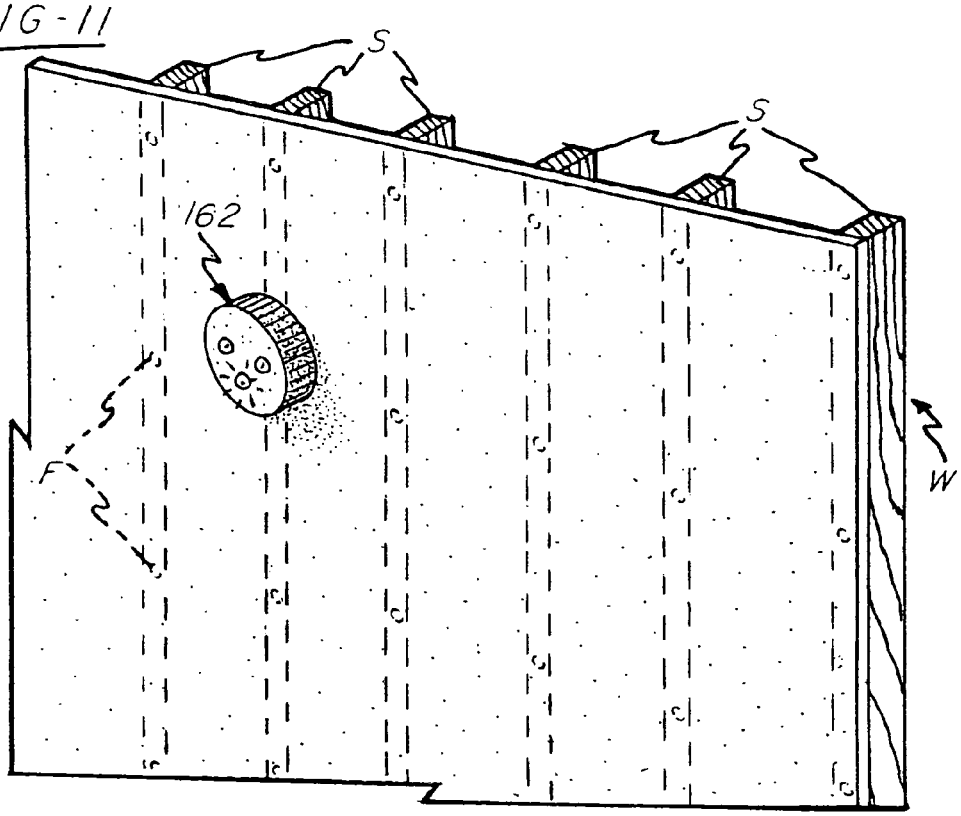
FIG. 11 is a perspective view of the end cap of FIG. 10 showing the end cap placed along a wall for use in locating a hidden nail or stud.

For installing shelving, pictures, or other such items, one often needs more than a thin wall for support. Further, to keep heavy or frequently used items, like a towel rack, the solid backing of a wall stud is required. Magnetic or electric stud finders are well known for locating screws and nails or other such fasteners that attach drywall to the wall stud. Referring to FIGS. 10 and 11, another preferred embodiment of the invention is shown whereby the end cap 118 includes a conventional nail and/or stud detector 162 for detecting studs S or nails, screws or other metallic fastener F behind the surface of a wall W. In a preferred embodiment, the stud detector 162 comprises a conventional electronic stud finder that operates by using a capacitance differential generated by differences in the dielectric constant along the surface of the wall W and uses a series of colored lights 164 to indicate the location of a stud S. As shown the end cap 118 can be removed from the handle body 114 and placed against the surface of a wall W whereby the operator slides the end cap 118 having the stud detector 162 along the surface of the wall W until the one or more of the colored lights 164 energizes to indicate the location of the stud S. Such electronic stud finders are well known in the art, two of which are shown in U.S. Pat. Nos. 3,845,384 and 4,099,118 to Stoutenberg et al. and Franklin et al., respectively.

Figure 12:
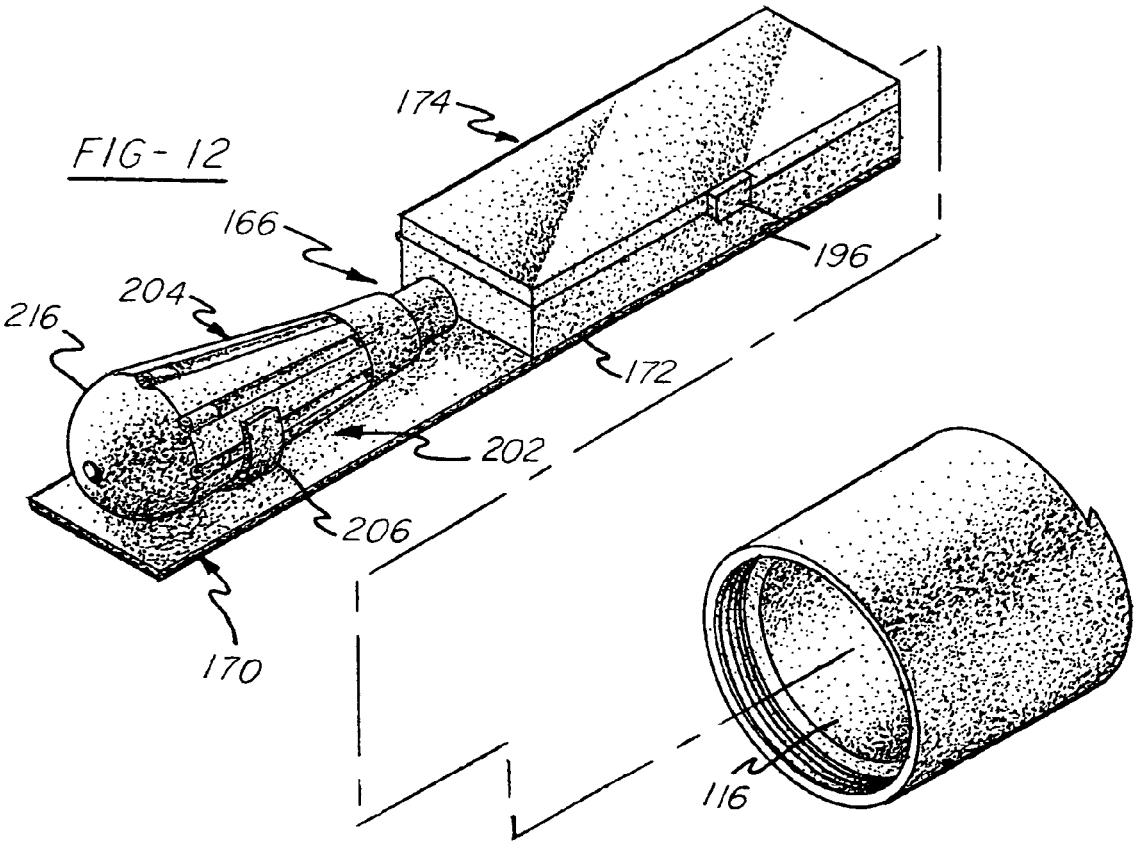
FIG. 12 is a partial view of another preferred embodiment of the hammer of the present invention showing the handle assembly with the removable tray removed from the handle.

Referring to FIGS. 3 and 12, another preferred embodiment of the invention is shown whereby positioned within the longitudinally extending cavity 116 of the handle assembly 112 of the hammer 100 is a removable tray 166 for storing an assortment of accessories 168, such as tools and/or supplies, and is adapted to fit within the longitudinally extending cavity 116 of the handle body 114. As shown, the tray 166 slides longitudinally through the cavity 116 and comprises a support wall 170 having a first part 172 for supporting a container 174. The container 174 is formed from integral first and second side walls 176 and 178, respectively, a front wall 180 and a rear wall 182 which cooperate to define an interior compartment 184. The upper ends of side walls 176 and 178, front wall 180, and rear wall 182 terminate in a common horizontal plane and define an open end, generally designated as 186. Access to accessories, such as tools, supplies, and the like, stored in the interior compartment 184, and may be readily had through the open end 186. A hinged lid 188 is provided to enclose the interior compartment 184. As shown, it should also be understood that the interior compartment 184 may also be divided by one or more interior walls 190 thereby permitting accessories, such as tools, supplies and the like stored, within the interior compartment 184 to be separated.

As shown, the lid 188 is connected to the container 174 by a longitudinally extending hinge 192, such as a thin wall membrane that is integrally formed with the container 174, that is arranged so that the lid 188 can be pivoted about a horizontal axis 194, adjacent to the upper edge of the rear wall 182, between a closed position, as shown in FIG. 12, where the lid 188 overlies and covers the open end 186, and an open position, such as shown in FIG. 1, where the lid 188 is disposed at an angle with respect to the horizontal plane of the open end 186. It should be understood that other types of hinges may be used and the particular type of hinge selected can be readily selected from a plurality of conventional hinges known by those skilled in the art for use in hinged containers.

Preferably, a conventional latch assembly 196 is mounted to the upper edge of the front wall 180 of the container 174. The latch assembly 196 cooperates with a locking projection 198, integrally formed on the lid 188, to latch the lid 188 in its closed position, as shown in FIG. 12, when desired. It should be understood that the particular latch assembly or assemblies selected can be readily selected from a plurality of conventional latch assemblies known by those skilled in the art for use with containers.

It should also be understood that in another preferred embodiment of the invention, the lid may also be constructed as a conventional lifting lid such that the sides of the lid extend over the outer surfaces of the container side walls 176 and 178, front 180 and rear walls 182 of the container 174. The lid is then removed by lifting the lid upwardly out of engagement with the container walls.

In a preferred embodiment of the invention, the tray 166 and the container 174 are formed from a molded plastic using conventional injection molding techniques. In another preferred embodiment of the invention, the tray 166 and the container 174 are formed from metal, such as aluminum or any other light weight material.

As shown in FIGS. 3 and 12, the tray 166 further includes a second part 200 having an attachment 202 for securing a second hand tool 204. As illustrated, the attachment 202 comprises a flexible clamping member 206 which is attached to the support wall 170 that together cooperate to define a C-shaped cylindrical grasping surface for receiving and retaining the hand tool 204. It should be understood that other conventional attaching means, such as straps manufactured by the American Velcro Company and sold under the trademark "VELCRO.", buckle straps, and other conventional means, can be used to secure the hand tool 204 to the tray 166 when the tray 166 is not in use.

Referring to FIGS. 2 and 11, in a preferred embodiment of the invention, the hand tool 204 includes a tool handle 208 having an inner cavity 210 for storing a plurality of smaller tools 212, bits and the like. One such hand tool is shown and described in U.S. patent application Ser. No. 10/113,913, filed Apr. 1, 2002 by Purkapile entitled "Multiblade Screwdriver" and incorporated herein by reference. It should be understood however, that other types of hand tools, such as a multi-purpose hand tools, screw drivers, wrenches, saws, flash lights, chisels, ratchets, or other such tools, can be used. It should be understood that the inner cavity 210 of the hand tool 204 can also include a slidably mounted tool tray 214 (not shown) adapted to support and hold the plurality of smaller tools 212 or tool attachments, such as tool bits. A removable cap 216 is placed at the end of the tool handle 208 to hold the tool tray 214 in position.

Figure 13:
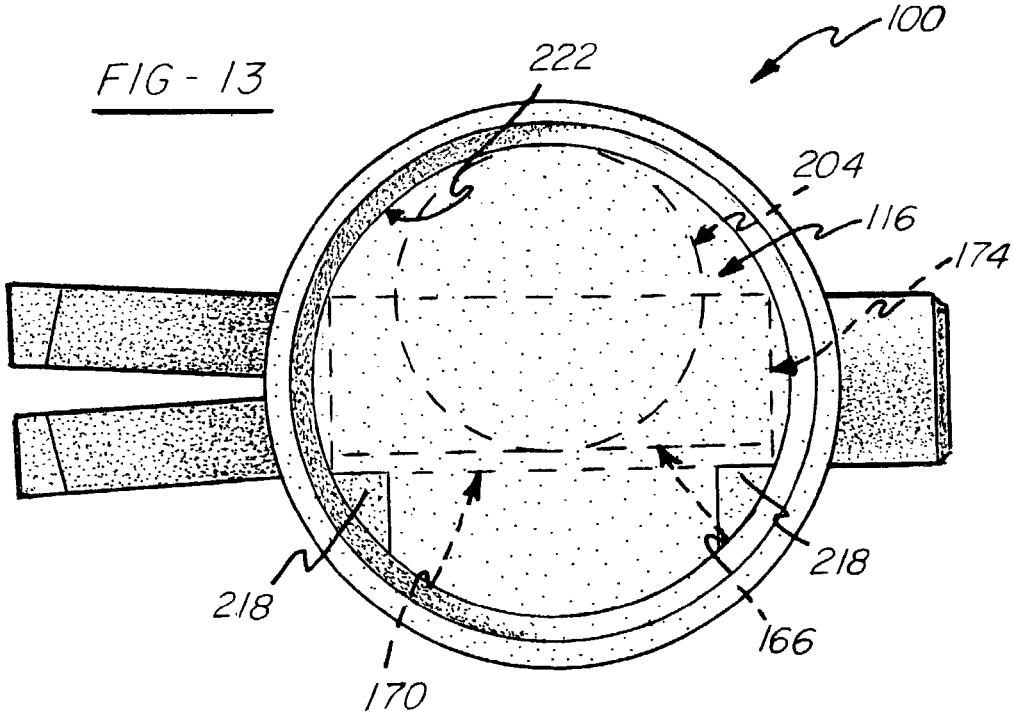
FIG. 13 is an end view of the handle assembly of a preferred embodiment of the invention showing the tray within the longitudinally extending cavity and resting along a pair of longitudinally extending rails.
Figure 14:
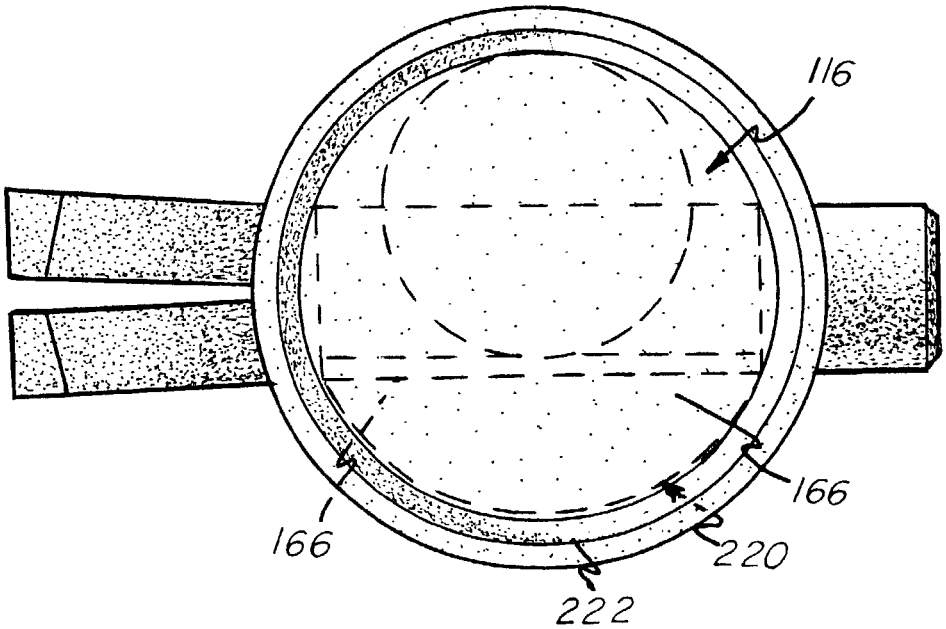
FIG. 14 is an end view of the handle assembly of a preferred embodiment of the invention showing the tray within the longitudinally extending cavity and having a rounded bottom surface.

Referring to FIGS. 2 and 3, in a preferred embodiment of the invention, the tray 166 is configured, such as by having a taper, so as to easily fit into the narrowing longitudinally extending cavity 116 formed within the tapered handle body 114. As shown, the upper portion of the container 174 together with the end portion of the tool handle 208 cooperate to contact the inner wall of the longitudinally extending cavity 116 to eliminate undesirable movement of the tray 166 within the longitudinally extending cavity 116 caused by movement of the hammer 100. It should be understood that the contour of the tray 166 can vary depending on the particular shape of the hammer 100. For example, as illustrated in FIG. 13, the longitudinally extending cavity 116 is constant in diameter and the tray 166 has no tapering. A pair of longitudinally extending rails 218 are positioned along the inner wall 222 of the longitudinally extending cavity 116 such that the support wall 170 of the tray 166 slidably rests on the rails 218 thereby permitting the tray 166 to longitudinally move in and out of the cavity 116. The rails 218 also operate and cooperate with the hand tool 204 and the container 174 to restrict or eliminate undesirable movement of the tray 166 caused by movement of the hammer 100. Other configurations, such as providing the tray 166 with a rounded bottom surface 220, as shown in FIG. 14, corresponding to the inner wall 222 of the longitudinally extending cavity 116 may also be utilized to prevent undesirable movement of the tray 166 within the cavity 116.

It should now be apparent to those skilled in the art that the hammer of the present invention comprises a variety of accessories and independent tools. Further, the hammer of the present includes at least one storage compartment adapted to efficiently and conveniently hold an additional number of accessories, such as other hand tools, supplies, and the like.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A combination hammer and screwdriver, said hammer comprising:

a hammer head having a front portion adapted for striking an object;

a handle having first and second ends and a hollow interior said first end attached to said handle, said second end providing an opening to said hollow interior and having a cap adapted to cover said opening;

a tray located in said interior said tray having a closable container and holding a plurality of fasteners;

said combination further comprising a screwdriver handle located in said hollow interior said screwdriver handle being hollow and containing a plurality of tools adapted to engage a screw.

2. The combination of claim 1 wherein said tray includes a level.

3. The hammer of claim 1 further comprising a retractable measuring tape.

4. A combination hammer and screwdriver, said hammer comprising:

a hammer head having a front portion adapted for striking an object;

a handle assembly having a handle body with a longitudinally extending cavity therein; and a tray tailored to fit and slide within said longitudinal extending cavity, said tray having a first portion for storing supplies and a second portion, a screwdriver handle supported on said second portion.

5. The combination of claim 4 having a retractable tape measure.

6. The hammer of claim 4 wherein said tray comprises a container effective for storing supplies and a clamping member for receiving and retaining said screwdriver handle.

7. The combination of claim 6 wherein said container includes a level.

* * * * *